US006736429B1

(12) United States Patent
Steeg

(10) Patent No.: US 6,736,429 B1
(45) Date of Patent: May 18, 2004

(54) AUTOGRAPH BALL

(76) Inventor: Robert M. Steeg, 201 St. Charles Ave., Suite 3201, New Orleans, LA (US) 70170

( * ) Notice: Subject to any disclaimer, the term of this patent is extended or adjusted under 35 U.S.C. 154(b) by 0 days.

(21) Appl. No.: 09/983,113

(22) Filed: Oct. 23, 2001

Related U.S. Application Data

(60) Provisional application No. 60/242,919, filed on Oct. 24, 2000.

(51) Int. Cl.[7] ..... B42D 15/00
(52) U.S. Cl. ..... 283/117
(58) Field of Search ..... 281/30, 15.1, 31, 281/51; 402/4; 273/317.6, 317.5; D19/35, 36, 41, 46

(56) References Cited

U.S. PATENT DOCUMENTS 2,486,840 A * 11/1949 Harris ..... 281/30
3,909,968 A * 10/1975 Bolstad ..... 40/358
4,907,824 A * 3/1990 Smirnoff ..... 281/30
5,137,453 A * 8/1992 Hudson ..... 434/408
5,356,136 A 10/1994 Ippolito
D357,500 S 4/1995 Mutterperl
D419,192 S * 1/2000 Huang ..... D19/78
6,082,774 A 7/2000 Schlauch

* cited by examiner

*Primary Examiner*—Willmon Fridie, Jr.
(74) *Attorney, Agent, or Firm*—Nixon & Vanderhye P.C.

(57) ABSTRACT

A combination writing surface and pen assembly that is used to facilitate obtaining autographs includes a sports object equivalent having a writing surface, in the shape of the object of a sport, capable of receiving writing or marking. A pen or other writing instrument has a writing end and a non-writing end, where a connector connects the pen to the sports object equivalent. There is preferably also a hole in the sports object equivalent for receiving the pen.

13 Claims, 1 Drawing Sheet

AUTOGRAPH BALL

CROSS-REFERENCES TO RELATED APPLICATIONS

This application claims the benefit of U.S. Provisional Patent Application Serial No. 60/242,919, filed Oct. 24, 2000, the entire content of which is herein incorporated by reference.

STATEMENT REGARDING FEDERALLY SPONSORED RESEARCH OR DEVELOPMENT

NOT APPLICABLE

BACKGROUND OF THE INVENTION

The present invention relates to sports and sports memorabilia. More particularly, the present invention relates to sports ball equivalents for obtaining autographs.

It is common practice for sports fans to seek autographs of sports players on sports balls. However, it is sometimes difficult to coordinate having a sports ball and pen available together at the same time when a sports player is encountered by a fan.

The following U.S. Patents are incorporated herein by reference: U.S. Pat. No. 5,356,136; Design Pat. No. D357, 500; and U.S. Pat. No. 6,082,774.

BRIEF SUMMARY OF THE INVENTION

A combination writing surface and writing instrument assembly that is used to facilitate the obtaining of autographs includes a sports object equivalent having a writing surface, in the shape of the object of a sport, capable of receiving writing or marking; a writing instrument capable of making an image such as an autograph or other written mark, the writing instrument having a writing end and a non-writing end; and a flexible and preferably durable means of connecting the writing instrument to the sports object equivalent attached to the non-writing end of the writing instrument and attached to the sports object equivalent. There is preferably also a hole in the sports object equivalent for receiving the writing instrument. The hole is preferably all the way through the sports object equivalent, and is preferably of such a diameter that the writing instrument fits snugly into the hole. The writing end of the writing instrument preferably remains inside the sports object equivalent when the writing instrument is inserted in the hole. The non-writing end of the writing instrument is preferably flush with the surface of the sports object equivalent and may be flared outward to prevent the writing instrument from sinking inside the sports object equivalent completely.

The sports object equivalent is preferably a "regulation" version of a ball that is actually used in a particular sport.

There can optionally be artwork or lettering or other graphics on the sports object equivalent such as the logo of a sports team or of a product, and the sports object equivalent can have different colors.

BRIEF DESCRIPTION OF THE DRAWINGS

For a further understanding of the nature, objects, and advantages of the present invention, reference should be had to the following detailed description, read in conjunction with the following drawing, wherein.

DETAILED DESCRIPTION OF THE INVENTION

Figure 1:
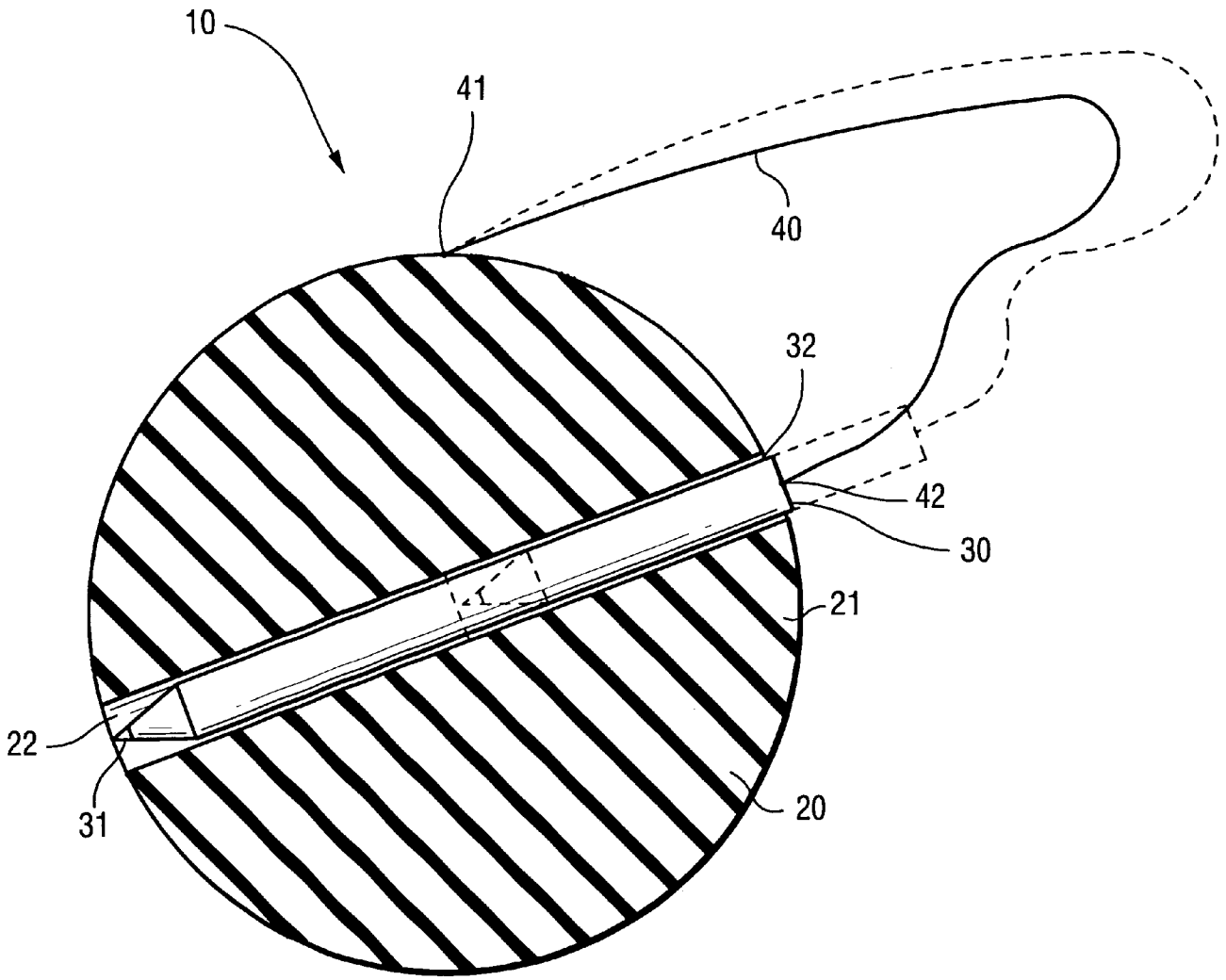
FIG. 1 shows a cross-section of the apparatus of the present invention.

The Autograph-Ball according to the present invention is a combination writing surface and writing instrument assembly that is used to facilitate the obtaining of autographs. The writing surface 21 is on a ball equivalent 20 in the shape of the object of a sport—usually a ball of some kind, but it could also take other shapes such as a hockey puck, golf club head, or the like. For ease of reference herein, the ball equivalent 20 with writing surface 21 will be referred to simply as a "ball," although other shapes may be used.

The ball 20 is capable of receiving writing or marking. The ball 20 may be a "regulation" version of a ball that is actually used in a particular sport, such as a hardball (baseball) or softball. Or it may be a different-scale version or other replica, having one or more qualities (such as size, weight and/or color) that are different from the "regulation" version used in a particular sport, such as a golf ball, football, tennis ball, or hockey puck.

The writing instrument 30 is any pencil, pen, marker or other instrument capable of making an image such as an autograph or other written mark. For ease of reference herein, the writing instrument will be referred to simply as a "pen," although any writing instrument may be utilized.

There is attached to the non-writing end 32 of the pen 30 a chain or cord 40 or other flexible and preferably durable means of connecting the pen to the ball (for ease of reference, it will be called the "cord"). The cord 40 may be coiled or straight and may be made of plastic, metal, string or any other flexible material. The first end 41 of the cord is attached to the ball 20, and the second end 42 is attached to the pen 30. The means of attachment of the cord on both ends (to the ball and to the pen) will be such that achieves a strong, durable attachment, not easily torn away or broken (such as with nail, tack, or durable glue) and is preferably permanent.

A hole 22 drilled into the ball 20 may extend through the ball or may extend only part way into the ball (shown in phantom). The hole 22 is preferably of such a diameter that the pen fits snugly into it. The pen 30 may extend through the hole 22, so that the writing end 31 of the pen 30 sticks out the other end of the ball when the pen is inserted. Alternatively, the pen may not extend through the ball, so that the writing end 31 of the pen 30 remains inside the ball 20 when the pen 30 is inserted. The non-writing end 32 of the pen 30 may be flush with the surface 21 of the ball, or the non-writing end may protrude outside the opening into which the pen was inserted. The non-writing end 32 of the pen 30 may be flared outward to prevent the pen 30 from being able to be inserted all the way inside the ball 20.

The Autograph-Ball is an invention that facilitates obtaining autographs on an object (such as a ball) by having a writing surface and a writing instrument attached to each other in an assembly that both (a) is easy to handle as one, unified whole and (b) keeps the writing instrument permanently attached in the vicinity of the writing surface.

The advantages of this invention include:

(1) The pen attached to the ball will not be dislodged or lost or discarded or misplaced, which would render the device meaningless as a means of obtaining autographs.

(2) Even though attached, the pen can be pulled away from the ball to a distance that is comfortable for writing.

(3) The pen remains attached to the ball even as it is being used to sign or mark the ball.

(4) When not in use, the writing instrument is inserted into the ball, so that the ball-and-pen combination may he handled as one unified assembly.

(5) By being inserted into the ball, the pen becomes integrated into the physical structure of the ball, and the entire assembly feels and seems like a ball. This establishes an identity between the game being played by the athlete whose autograph is desired and the assembly being used to obtain the autograph. It makes the autograph seeker more likely to take the autograph-ball with him or her to a sporting event. The assembly preferably has the "heft" and "feel" of a real ball, and the attachment of the pen to the ball does not prevent this from being so.

(6) The assembly (with pen inserted) is easily transportable to and from the place where the signing of the autographs takes place. The pen remains attached and out of the way during transport.

(7) The assembly (with pen inserted) may be easily tossed to and from the person from whom the autograph is sought, and the pen remains attached and out of the way during this action.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A combination writing surface and writing instrument apparatus that is used to facilitate obtaining autographs, comprising:

a sports object equivalent having a writing surface, the sports object equivalent being in a shape of an object of a sport;

a writing instrument having a writing end and a non-writing end; and a connector connecting the non-writing end of the writing instrument and the sports object equivalent, wherein the sports object equivalent has a hole therein for receiving the writing instrument, wherein the hole extends completely through the sports object equivalent, and wherein the writing end of the writing instrument remains inside the sports object equivalent when the writing instrument is inserted into the hole.

2. The apparatus according to claim 1, wherein the connector is flexible.

3. The apparatus according to claim 1, wherein the connector is permanently attached to the non-writing end of the writing instrument and permanently attached to the sports object equivalent.

4. The apparatus according to claim 1, wherein the hole is of such a diameter that the writing instrument fits snugly into the hole.

5. The apparatus according to claim 1, wherein the hole is of such a diameter that the writing instrument fits snugly into the hole.

6. A combination writing surface and writing instrument apparatus that is used to facilitate obtaining autographs, comprising:

a sports object equivalent having a writing surface, the sports object equivalent being in a shape of an object of a sport;

a writing instrument having a writing end and a non-writing end; and a connector connecting the non-writing end of the writing instrument and the sports object equivalent, wherein the sports object equivalent has a hole therein for receiving the writing instrument, and wherein the non-writing end of the writing instrument is flared from a width smaller than the diameter of the hole to a width larger than the diameter of the hole.

7. A combination writing surface and writing instrument apparatus that is used to facilitate obtaining autographs, comprising:

a sports object equivalent having a writing surface, the sports object equivalent being in a shape of an object of a sport;

a writing instrument having a writing end and a non-writing end; and a connector connecting the non-writing end of the writing instrument and the sports object equivalent, wherein the sports object equivalent has a hole therein for receiving the writing instrument, and wherein the non-writing end of the writing instrument is substantially flush with an exterior surface of the sports object equivalent when the writing instrument is inserted into the hole.

8. The apparatus according to claim 1, wherein the sports object equivalent is a regulation version of a sports object used in a particular sport.

9. The apparatus according to claim 8, wherein the sports object equivalent is a ball.

10. The apparatus according to claim 1, further comprising graphics on the sports object equivalent.

11. The apparatus according to claim 1, wherein the sports object equivalent bears a logo of a sports team or of a product.

12. An object for receiving autographs, the object comprising:

a sports object equivalent in a shape of an object of a sport, the sports object equivalent having a hole therein; and a writing instrument attached to the sports object equivalent and shaped to fit into the hole, wherein the hole extends completely through the sports object equivalent, and wherein a writing end of the writing instrument is disposed inside the sports object equivalent when the writing instrument is inserted into the hole.

13. An object according to claim 12, wherein a non-writing end of the writing instrument is flared from a width smaller than a diameter of the hole to a width larger than the diameter of the hole.

* * * * *